United States Patent [19]

Koski

[11] 3,941,651

[45] Mar. 2, 1976

[54] TWIN-WIRE PAPER MANUFACTURING MACHINES

[75] Inventor: Erkki Koski, Jyvaskyla, Finland

[73] Assignee: Valmet Oy, Finland

[22] Filed: Mar. 22, 1974

[21] Appl. No.: 453,813

[30] Foreign Application Priority Data

Mar. 23, 1973 Finland ..... 919/73

[52] U.S. Cl. ..... 162/301; 162/352

[51] Int. Cl.[2] ..... D21F 1/00

[58] Field of Search ..... 162/301, 300, 303, 344, 162/351, 352, 363, 203, 208, 210, 211, 212, DIG. 7

[56] References Cited

UNITED STATES PATENTS

| | | | |
|---|---|---|---|
| 3,236,724 | 2/1966 | Wahlström | 162/203 |
| 3,543,834 | 12/1970 | Stuebe | 162/300 |
| 3,565,757 | 2/1971 | Jordansson | 162/301 |
| 3,726,758 | 4/1973 | Parker et al. | 162/301 X |
| 3,746,613 | 7/1973 | Vauhkonen | 162/301 |

*Primary Examiner*—S. Leon Bashore
*Assistant Examiner*—Richard V. Fisher
*Attorney, Agent, or Firm*—Steinberg & Blake

[57] ABSTRACT

A twin-wire paper manufacturing machine wherein endless main and auxiliary wires are situated directly next to each other only at a convex forming surface of a forming board so that the compacting of the web takes place only between those parts of the main and auxiliary wires which assume the curvature of the forming surface. Preferably the curved forming surface forms part of a cylinder of constant radius so that the curvature of the wires during compacting of the web therebetween also is constant. By driving the wires at the same angular velocity as they travel along the forming surface, relative movement between the wires during compacting of the web therebetween is reduced to a minimum.

8 Claims, 1 Drawing Figure

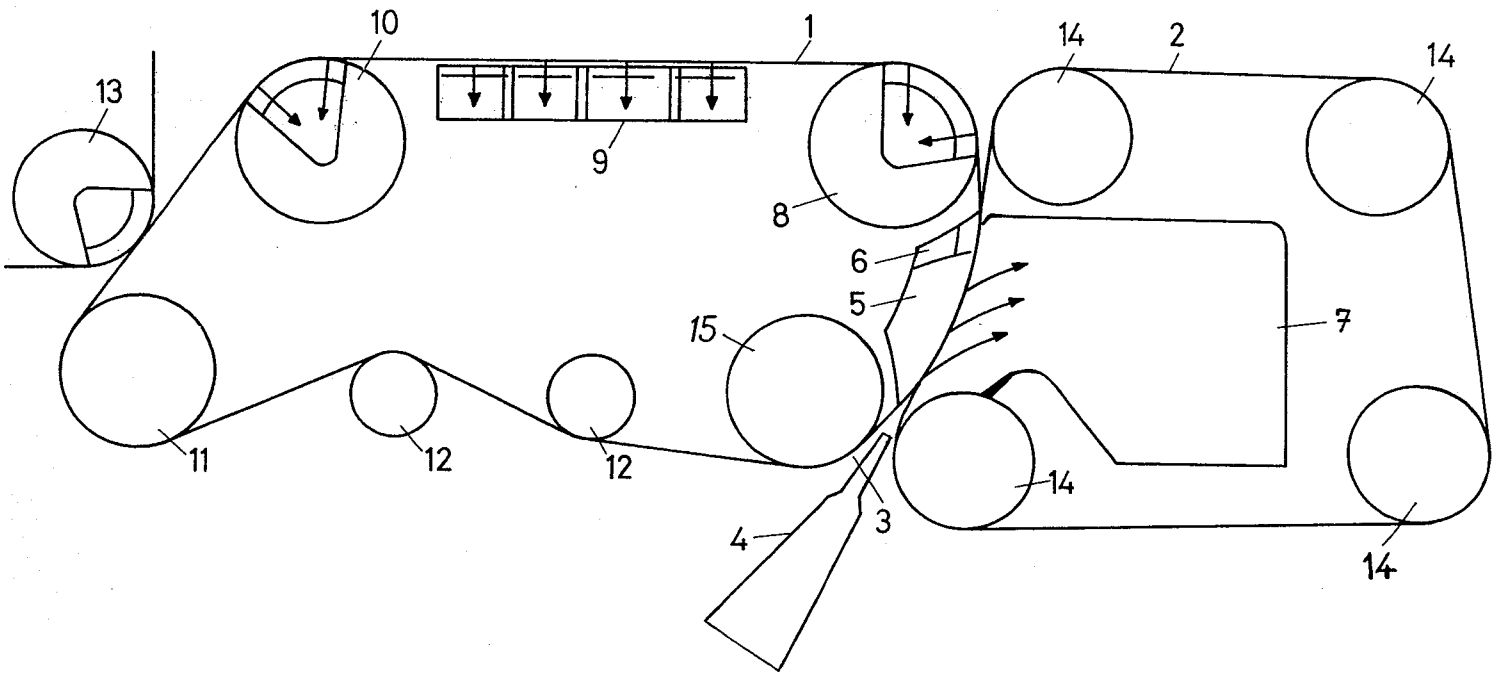
14
14
2
14
14
7
1
8
6
5
3
4
15
9
12
12
10
11
13

TWIN-WIRE PAPER MANUFACTURING MACHINES

BACKGROUND OF THE INVENTION

The present invention relates to machines for manufacturing paper.

In particular, the present invention relates to twin-wire machines of this type.

Machines of the above type have main and auxiliary endless wires which have portions situated directly next to each other to compact the web therebetween. The wires have parts which converge toward each other to receive the stock or pulp slurry from the headbox, and as the web is compacted between the wires at the portions which move away from the headbox dewatering takes place through one or both of the wires.

Known machines of the above type require the parts of the wires which are directly next to each other to compact the web therebetween to travel along a path which is both straight and curved. Thus, the parts of the wires which are situated directly next to each other to compact the web therebetween are required at one location to assume a given curvature and at another location to be straight. At the curved parts of the wires, the outer wire should travel at a velocity higher than the inner wire because the outer wire has a larger radius of curvature resulting from the thickness of the wires as well as the thickness of the web interposed and compacted between the wires. If the portions of the wires between which the web is compressed respectively travel at different speeds, so that they have the same angular velocities when travelling along a curve, then these wires will necessarily also have different speeds when travelling along a straight path while compacting the web between the wires, with the result that harmful shearing forces and deformation of the web which is formed between the wires takes place. Since the pair of wires must have different speeds one with respect to the other either at the curved part or at the straight part of their joint path of movement, since it is impossible for them to have equal speeds at both of these parts of their joint path, such harmful shearing forces and deformation of the web which is forming cannot be avoided.

In order to at least attempt to solve this problem it has been common practice to select for the wires speeds which will constitute a compromise which will reduce these undesirable effects as much as possible. However, the results have always been far from satisfactory.

A further disadvantage encountered with conventional machines of the above type, particularly those which have comparatively long twin-wire sections, results from the fact that water tends to fall from the auxiliary wire down onto the web carried by the main wire at the location where the auxiliary wire separates itself from the main wire before returning to the joint path of movement. These falling drops of water which become deposited on the web leave permanent and objectionable marks on the finished product.

SUMMARY OF THE INVENTION

It is accordingly a primary object of the present invention to provide a twin-wire paper machine which will avoid the above drawbacks.

In particular it is an object of the present invention to provide a construction which makes it possible to eliminate any relative movement between the two wires as they travel along a joint path while compacting a web therebetween, so that in this way the harmful shearing forces and deformation of the web will be avoided.

In addition it is an object of the present invention to provide a construction of this type which will have an effective dewatering action.

Furthermore it is an object of the present invention to provide a construction where the parts are arranged in such a way that drops of water will not fall from the auxiliary wire onto the web which forms on the main wire.

Also it is an object of the present invention to provide a machine of the above type capable of effectively feeding stock to the wires to be compacted therebetween.

According to the invention the main and auxiliary wires are guided by main and auxiliary rollers so as to travel concurrently along a convexly curved forming surface of a forming board or shoe, with the arrangement being such that compacting of the web between the wires takes place only along this convex forming surface. Preferably the latter surface forms part of a cylinder which has a constant radius so that the curvature of the forming surface as well as the parts of the wires which travel concurrently therealong remains unchanged. In this way it is possible to provide for the pair of wires the same angular velocity as they travel concurrently along the joint path determined by the convexly curved forming surface, thus eliminating the detrimental shearing forces and deformation of the web during the formation thereof between the twin wires. Preferably the rear end of the forming board or shoe has a suction means which contributes to the dewatering action. Also the joint path of travel of the wires is arranged so as to be directed upwardly as well as obliquely.

BRIEF DESCRIPTION OF DRAWING

The invention is illustrated by way of example in the accompanying drawing which forms part of this application and which illustrates schematically one possible embodiment of a paper manufacturing machine which incorporates the features of the present invention.

DESCRIPTION OF A PREFERRED EMBODIMENT

As may be seen from the drawing, the illustrated machine has twin wires one of which is formed by the endless main wire means 1 and the other of which of which is formed by the endless auxiliary wire means 2. The endless main wire means 1 is guided for movement by a main roller means which includes the several rollers 8, 10–12, and 15. Between the rollers 8 and 15 of the main roller means is a forming means 5 in the form of an elongated forming board or shoe having an outwardly directed convex forming surface surrounded and engaged by the main wire means 1.

The endless auxiliary wire means 2 is guided for movement by an auxiliary roller means which includes the plurality of rollers 14 illustrated in the drawing. The left pair of rollers 14, as viewed in the drawing, guide the auxiliary wire means 2 for movement along the curved forming surface of the forming means 5 concurrently with the main wire means 1. The forming means 5 has a lower front end and an upper rear end, and the wires 1 and 2 travel upwardly from the front to the rear end of the forming means 5.

The lower left roller 14 of the auxiliary roller means and the roller 15 of the main roller means are situated adjacent the front end of the forming means 5 and provide for the wires 1 and 2 portions which converge toward each other as they approach the front end of the forming means 5, so as to define in this way the converging gap 3 into which the pulp slurry or stock is fed, from a headbox which is under pressure, through the illustrated nozzle slice 4 which thus delivers the stock into the gap 3 to be received between the main and auxiliary wires which thus compress the web during the initial formation thereof as the wires travel concurrently along the joint path determined by the convex outer surface of the forming means 5. The positions of the upper left roller 14 of the auxiliary roller means and the roller 8 of the main roller means are such that they provide for the wires 1 and 2 portions which diverge away from each other as they travel beyond the upper rear end of the forming means 5.

It will be noted that while the forming means 5 is arranged in a generally upright direction, it is also obliquely inclined upwardly toward the right, as viewed in the drawing, so that the upper rear end of the forming means 5 is situated over the lower left roller 14, as viewed in the drawing, and in this way the curvature of the wires 1 and 2 as they travel along the forming surface is assured.

The outer convex forming surface of the forming means 5 forms part of a cylinder of constant radius so that in the plane of the drawing the curved forming surface forms part of a circle, and in this way the curvature of the forming surface as well as of the wires 1 and 2 where they travel along the joint path determined by the forming surface remains unchanged, and by imparting to the wires a speed which will provide for the wires the same angular velocity along the forming surface there will be no relative movement between the wires as they travel along the forming surface, thus eliminating any possible detrimental shearing forces or deformation of the web which forms between the wires, inasmuch as with the construction of the invention the wires 1 and 2 travel concurrently along the joint path determined by the curved forming surface but otherwise do not have any common path of travel.

Preferably, the upper rear end region of the forming means 5 includes a suction means 6 in the form of a suitably constructed suction box which contributes to the dewatering action.

Thus, the wires 1 and 2 travel together only along the upwardly directed oblique path determined by the forming means 5, and along this part of the path water will escape from the web due to centrifugal action through the auxiliary wire 2 into a saveall means 7 surrounded by the wire 2 and communicating with the part thereof which travels along the forming means 5, in the manner shown schematically by the arrows in the drawing. This centrifugal dewatering into the saveall 7 and dewatering from suction at the suction means 6 which forms part of the forming means 5 achieves an effective dewatering action for the web which is compacted between the twin wires.

As the main wire 1 travels upwardly beyond the forming means 5, it passes around the roller 8 in the form of a return roll having a suction zone as schematically illustrated. From the roller 8 the main wire has a straight or planar wire section which travels over the suction boxes 9. Of course the web is retained on the main wire 1 as a result of the suction action at the roller 8. From the suction boxes 9 the main wire travels around a return roller 10 also provided with a suction means. From the roller 10 the wire passes around an additional return roller 11 and then along the additional guide rolls 12, which may function as tension rolls, before returning to the roller 15 which directs the main wire back to the front end of the forming means 5.

The part of the main wire 1 which travels between the rollers 10 and 11 is engaged by a pick-up roll 13 by means of which the web formed on the main wire 1 is separated therefrom to be transported away from the main wire 1 and delivered to a press section.

The auxiliary wire 2 after diverging away from the upper rear end of the forming means 5, as a result of the guiding of the wire 2 by the upper left roller 14 of the drawing, is then guided over the pair of right rollers 14 of the drawing before returning to the lower left roller 14 from where the auxiliary wire 2 returns to the front end of the forming means 5.

It will be noted that the position of the upper left guide roller 14 is such that the auxiliary wire 2 is inclined upwardly toward the right as it moves beyond the upper rear end of the forming means 5. Therefore it is not possible for any drops of water to fall from the auxiliary wire onto the web which forms on the main wire 1.

The speeds at which the main wire 1 and the auxiliary wire 2 travel are selected so that their angular velocities with respect to the center of curvature of the forming surface are at least substantially equal. As a result there are no harmful shearing forces or deformations in the web which forms between the wires while they are urged toward the convexly curved forming surface. Inasmuch as the path of joint travel of the main and auxiliary wires is limited only to the section which is contiguous with the forming means 5, no undesirable effects are encountered even though the linear or peripheral velocities of the wires may be different from each other.

What is claimed is:

1. In a twin-wire paper manufacturing machine, stationary forming means having front and rear ends and an outer convex forming surface extending between said front and rear ends, endless main wire means surrounding and engaging said forming means so that a portion of said main wire means assumes the curvature of said forming surface for moving therealong from said front to said rear end thereof, main roller means guiding said main wire means for movement along said forming surface of said forming means, said main roller means including a pair of rollers respectively situated adjacent and before and after said front and rear ends of said forming means for guiding a portion of said main wire means to and from said front and rear ends of said forming means, auxiliary endless wire means and auxiliary roller means engaging said auxiliary wire means to guide the latter for movement, said auxiliary roller means also including a pair of rollers respectively situated adjacent said front and rear ends of said forming means for guiding a portion of said auxiliary wire means to and from the regions of said front and rear ends of said forming means for providing said auxiliary wire means with a portion also assuming the curvature of said forming surface and capable of moving concurrently with said portion of said main wire means which travels along said forming surface, the rollers of said main and auxiliary roller means which are situated before said front end of said forming means providing said main and auxiliary wire means with converging portions which converge toward each other as they approach said front end of said forming means and the pair of rollers of said main and auxiliary roller means which are situated adjacent the rear end of said forming means providing said main and auxiliary wire means with portions which diverge away from each other between the latter pair of rollers and said rear end of said forming means as said main and auxiliary wire means move beyond the rear end of said forming means, so that said main and auxiliary wire means separate from each other at the region of the rear end of said forming means, said main and auxiliary wire means being situated next to each other only at their portions which assume the curvature of said forming surface, means for driving the latter portions at the same angular velocities to reduce to a minimum the relative movement between the latter portions, and stock feeding means situated adjacent said rollers which are situated adjacent the front end of said forming means for feeding stock into a space defined between the portions of said main and auxiliary wire means which converge toward each other as they approach said front end of said forming means, whereby initial web formation and the entire compression between both of said wire means take place only at those portions of said wire means which move concurrently along said stationary forming means.

2. The combination of claim 1 and wherein said forming surface of said forming means forms part of a cylinder of constant radius, so that the curvature of said forming surface as well as the portions of said main and auxiliary wire means which travel therealong remains unchanged.

3. The combination of claim 1 and wherein a suction means forms part of said forming means at the region of said rear end thereof for providing at least part of a dewatering action.

4. The combination of claim 1 and wherein a saveall means is situated at the interior of said auxiliary wire means communicating with the portion thereof which moves concurrently with said main wire means to receive water as a result of centrifugal force.

5. The combination of claim 1 and wherein said front end of said forming means is lower than said rear end thereof.

6. The combination of claim 5 and wherein said stock-feeding means is in the form of a nozzle slice having a discharge end extending into said space between the portions of said main and auxiliary wire means which converge toward said front end of said forming means.

7. The combination of claim 5 and wherein said forming means is arranged in a generally upright but oblique position with the rear end of said forming means situated over that one of said rollers of said auxiliary roller means which is situated adjacent said front end of said forming means.

8. The combination of claim 7 and wherein that one of said rollers of said auxiliary roller means which is situated adjacent the rear end of said forming means is located in its entirety to one side of the forming means for directing the auxiliary wire means from the rear end region of said forming means upwardly and away from said forming means in a manner preventing any water from dropping from the auxiliary wire means as it travels away from said forming means onto a web carried by said main wire means.

* * * * *